US008167450B2

(12) United States Patent
Hudson

(10) Patent No.: US 8,167,450 B2
(45) Date of Patent: May 1, 2012

(54) PORTABLE LIGHTING DEVICE

(75) Inventor: Jack F. Hudson, Tequesta, FL (US)

(73) Assignee: Open Water Products, LLC, Tequesta, FL (US)

( * ) Notice: Subject to any disclaimer, the term of this patent is extended or adjusted under 35 U.S.C. 154(b) by 212 days.

(21) Appl. No.: 12/752,592

(22) Filed: Apr. 1, 2010

(65) Prior Publication Data

US 2011/0242801 A1 Oct. 6, 2011

(51) Int. Cl.
*F21L 4/00* (2006.01)

(52) U.S. Cl. ..... 362/191; 362/190; 362/183; 362/182; 362/185; 362/186

(58) Field of Classification Search ..... 362/185, 362/186, 190, 191, 103, 183
See application file for complete search history.

(56) References Cited

U.S. PATENT DOCUMENTS 4,845,597 A 7/1989 McCaghren
5,216,972 A 6/1993 Dufrene
6,968,796 B1 11/2005 Burke
2004/0100792 A1* 5/2004 Trzecieski ..... 362/103
2009/0193630 A1* 8/2009 Petzl et al. ..... 24/305
2010/0188863 A1* 7/2010 West ..... 362/418
2011/0007502 A1* 1/2011 Chen ..... 362/191
* cited by examiner

*Primary Examiner* — Evan Dzierzynski
(74) *Attorney, Agent, or Firm* — McHale & Slavin, P.A.

(57) ABSTRACT

Disclosed is a portable light that can be secured to most any fixed object by use of an elastic band attachment mechanism. The elastic band securement device is form fitting and fully adjustable with the ends of the securement device placed beneath a cover of the light during installation, wherein the cover of the light conceals the attachment mechanism to prevent accidental disengagement of the light from the object of attachment. In operation, the base of the light has a cover which is secured by a latch, hook and loop, thumb screws or any other type of fastener which upon removal exposes the light and the two ends of the elastic cord. A portion of the elastic cord is secured around a fixed object and the bitter end of the cord is drawn tight and placed through a cord fastener so as to secure the cord in a secured and tensioned position. The cover is then replaced, thereby concealing the ends of the elastic band from disengagement. The light can then be operated in a usual manner by the use of an on/off switch.

21 Claims, 4 Drawing Sheets

PORTABLE LIGHTING DEVICE

FIELD OF THE INVENTION

This invention is directed to the field of portable lighting devices, and in particular, a portable lighting device employing a flexible elastic cord allowing securement of the portable light to most any fixed object.

BACKGROUND OF THE INVENTION

The need for portable lighting is well known, and the uses for a portable light are unlimited. Whether an activity is active or passive, when low lighting conditions exist, the need for portable lighting can increase the safety of any activity.

While most portable lighting devices rely upon a battery source for power, portability may become a disadvantage during use. In many instances, the use of the portable lighting device is best accomplished when the light is held stationary. For example, a portable light could be used to illuminate a boat dock on a temporary basis, or in instances where the use of alternating current is difficult. Should a dock be used for entertainment, the safety of individuals on the dock is increased by outlining the dock edges. In this example, the securement of a conventional light, such as a flashlight or lantern may not be practical. Unless a light is properly secured, the light could be moved by wind, wave, or accidentally dropped into the water by an individual walking along the dock.

Portable lighting devices are even more prone for movement when placed on an actively moving object. For instance, a boat would benefit from a portable lighting device that can be held in a fixed position. In such an instance, a lighting device may be necessary to illuminate a walkway, cockpit, side rail or the like, wherein the movement of the boat would make it impractical to simply lay a lantern or flashlight near the source when lighting is necessary and hope that the lighting source would remain stationary. If a portable light is not properly secured, the portable light can actually become a hazard to the individuals using the boat should it fall beneath their feet.

While it would be possible to strap a lantern to a passive or actively moving object, the adaptation of the lighting device to a fixed object may be unsightly, be easy to uninstall if the securement mechanism is in view of the public, and securement may require a tying skill particular to an individual. For instance, if a lantern is secured to a boat vessel by a line, the skill of the individual tying the line knot would determine whether or not the lighting object would remain stationary. The use of flexible cords, such as rubber bands and elastic cord, provides yet another option, but the securement method would be open for the public to tamper with.

Thus, while there are an infinite amount of examples to illustrate the benefit of a portable light being secured to a fixed object, what is lacking in the art is a portable light capable of securement to a fixed object wherein the attachment mechanism allows adaptation to most any size object, and the attachment mechanism is concealed from view to inhibit accidental detachment.

SUMMARY OF THE INVENTION

The instant invention is a portable light operated by the use of direct current available from a storage battery. The portable light includes a flexible cord that extends through the base of the lighting device for securement to a fixed object. In a preferred embodiment, the base of the lighting device is raised so as to allow the light to be secured over a coupling object, such as a cleat, thereby fully concealing the cleat as well as the flexible cord used in the attachment. In operation, the base of the light has a cover which is secured by a latch, Velcro, thumb screws or any other type of fastener which, upon removal, exposes the light and the two ends of the elastic cord. A portion of the elastic cord is secured around a fixed object and the bitter end of the cord is drawn tight and placed through a cord fastener so as to secure the cord in a secured and tensioned position. The cover is then replaced, thereby concealing the ends of the elastic band from disengagement. The light can then be operated in a usual manner by the use of an on/off switch.

Accordingly, it is an objective of the instant invention to provide a portable light having a flexible cord that provides an adjustable securement band for securing of the light to most any object.

It is a further objective of the instant invention to provide a portable light with an attachment mechanism that is easily secured in position and can then be concealed from sight.

It is yet another objective of the instant invention to provide a low cost portable light having a raised base capable of concealing objects of attachment.

It is still another objective of the invention to provide a portable light that can be secured to most any object having a securement mechanism that will not mar a surface, and can be used in electrically conducted areas without the possibility of causing an electrical short.

Yet still another objective of the instant invention is to provide a portable lighting apparatus that can be used in wet and corrosive environments.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
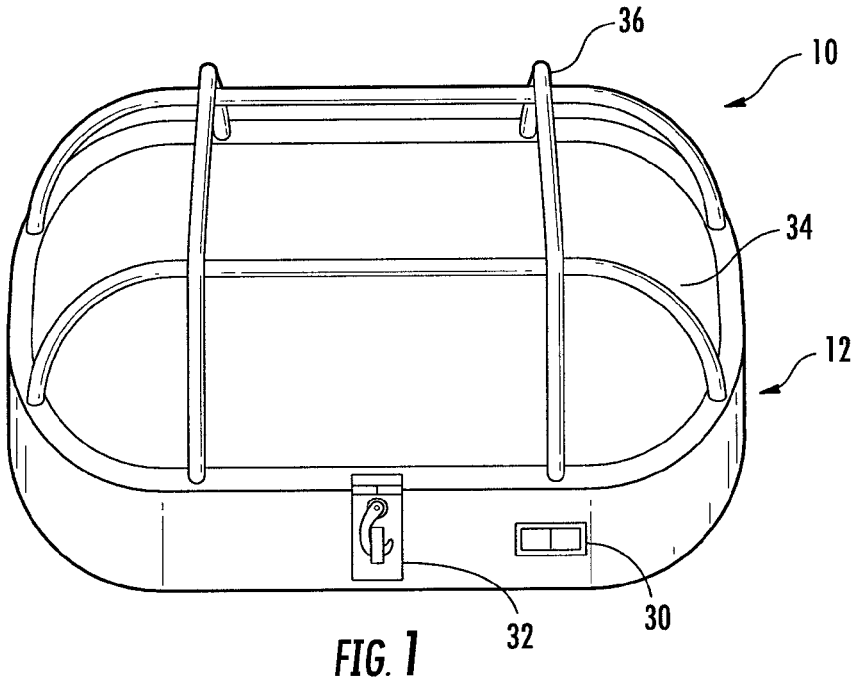
FIG. 1 is a perspective view of the instant invention.

While the present invention is susceptible of embodiment in various fauns, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Now referring to the figures, set forth is an embodiment of the invention comprising a portable light (10) having a base (12) and an elevated support plate (14). The support plate (14) is further defined by a perimeter edge (16) with the support plate having an upper surface (18) and a lower surface (20) elevated by use of a continuous side wall (22) so as to maintain the support plate (14) from the surface of an object (100) by a distance (d). The distance can be from a ¼ inch to most any height and, as will be explained later, the distance is dependent upon the required objects spacing. In a conventional application the distance (d) is about 2 inches, which is capable of accommodating most any imperfection or item that the light is attached to.

In the preferred embodiment, the side wall may include an electric on/off switch (30) for use in controlling the electric light, as well as a latching mechanism (32) for use in securing the cover (34) to the base (12). The sidewall may be sized wherein the latching mechanism (32) and electric switch (30) can be mounted in such a position so that the bottom of the continuous side wall can be trimmed to conform to the size of a particular item to be concealed. In such an instance, the side wall could include a construction that allows for ease of side wall reduction, as it will be noted that the side wall is primarily for positioning of the support plate over the object of attachment, and the space between the object and the bottom of the support plate can be sized to accommodate any item that is used for attaching the light to the object. The cover (34) includes a transparent or translucent lens to allow illumination outwardly from the support plate. In this embodiment the cover includes a series of grates (36) that are used to provide protection to the cover as well as add an aesthetic appeal to the lighting mechanism. The hinge (40) couples the cover to the base and can be made of most any material or configuration. Disclosed is a latching mechanism in the form of a hasp which serves the function of securing the cover to the base and provides an ornamental aesthetically pleasing latching mechanism.

Figure 2:
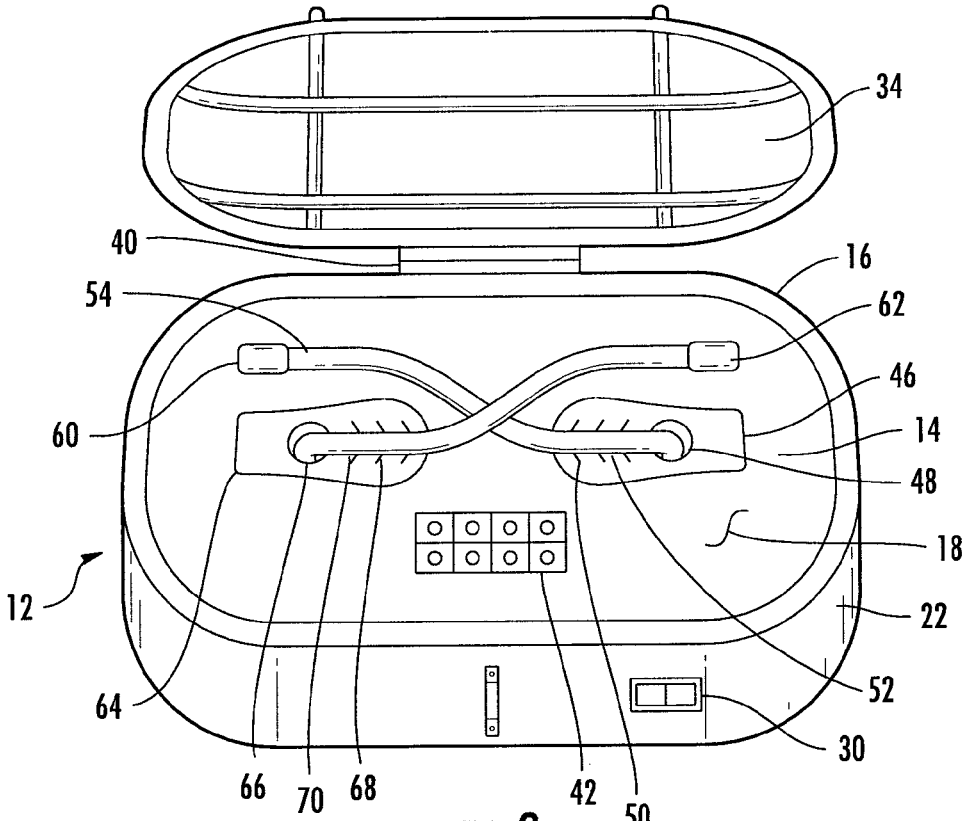
FIG. 2 is a perspective view with the cover of the lighting device in an open position.

The cover can be secured to the base by most any latching mechanism including hook and pile, bolt and nut, snaps secured to the base and the cover or formed integral therein, and so forth. The cover (34) is shown in FIG. 2 in an open position with hinge (40) maintaining the cover (34) to the base (12). The upper surface (18) of the support plate (14) includes a lighting mechanism, shown in this embodiment as being a series of light illuminated diodes (LED's) (42) that are powered by a portable battery source, such as lithium batteries, which are placed directly beneath the LED's. For convenience purposes, a switch (30) is placed on the side wall (22) that allows operation of the light whenever the cover is in a closed position so as to maintain a seal between the cover and the base.

FIG. 2 shows a first cord fastener (46) having an aperture (48) and a plurality of engagement tabs (50) which are angular position tabs forming a cord slot (52) wherein the elastic cord (54) can be drawn through the slot (52) by placing the elastic cord in tension mode by stretching, wherein the elastic cord diameter is reduced, allowing placement within the cord slot. Upon release of the cord tension, the cord swells to its conventional size, wherein the elasticity maintains the cord within the cord slot and the angular positioned engagement tabs (50) prevent a cord from being pulled back through the aperture (48). In this embodiment, the first end (60) of the cord (54) extends through the aperture (48) of the first cord fastener (46) and wraps around an object beneath the support plate (14) wherein a second end (62) of the cord extends through the second cord fastener (64) of the aperture (66) in angular position engagement tabs (68) foaming the cord slot (70). As with the first cord fastener, the second cord fastener allows engagement of the cord by placing the cord in a tension mode by pulling on second end (62) thereby reducing the diameter of the cord, allowing placement within the cord slot (70). Upon release of the second end (62), the cord (54) returns to its normal size engaging the angular positioned engagement tabs (68) so as to prevent retraction of the cord back through the aperture (66).

Figure 4:
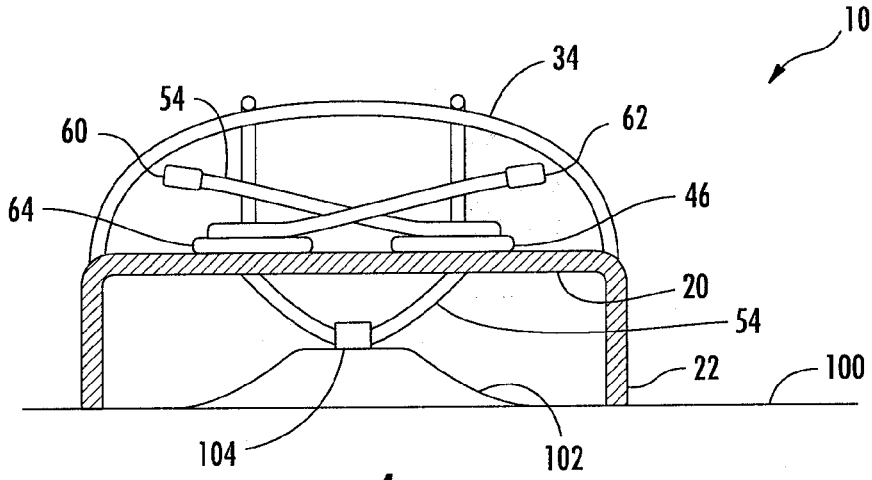
FIG. 4 is a cross-sectional side view of the lighting device attached to a surface by use of a suction cup.
Figure 3:
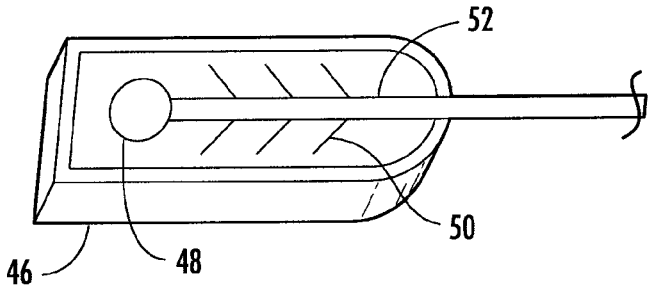
FIG. 3 is an enlarged view of the cord fastener.

FIG. 3 sets forth an enlarged view of the cord fastener (46) having an aperture (48) with angular engagement tabs (50) forming cord slot (52). It should be noted that the cord fastener (46) may be secured to the support plate (14) or formed integral therewith. FIG. 4 depicts a side view showing the side wall (22) of the light (10) spaced above the surface (100) of an object. In this embodiment, a suction cup (102) is secured to the flat surface (100) and the elastic cord (54) is placed through a cord engagement tab (104). In operation, the first end (60) of the elastic cord (54) is drawn through the cord fastener (46) and wrapped around the cord engagement tab (104) and drawn through the second cord fastener (64) where the second end (62) is drawn tight so as to cinch the cord within the cord fasteners (46 and 64) as previously described. Once the elastic cord has been placed in tension, the cover (34) may be closed and locked in position so as to conceal the ends of the cord and otherwise secure the light (10) to the surface (100). The suction cup allows attachment to fiberglass, plastic, glass, or smooth metal. For instance, the light could be attached to a fiberglass hull or a windshield of a boat. Alternatively, a magnet could be employed, not shown, that would operate in the same manner as the suction cup. Unlike the suction cup, a magnet allows attachment to most any metal object despite the surface smoothness. For instance, the magnet would allow attachment of the lighting device to the nails used to secure a plank to a dock.

Figure 5:
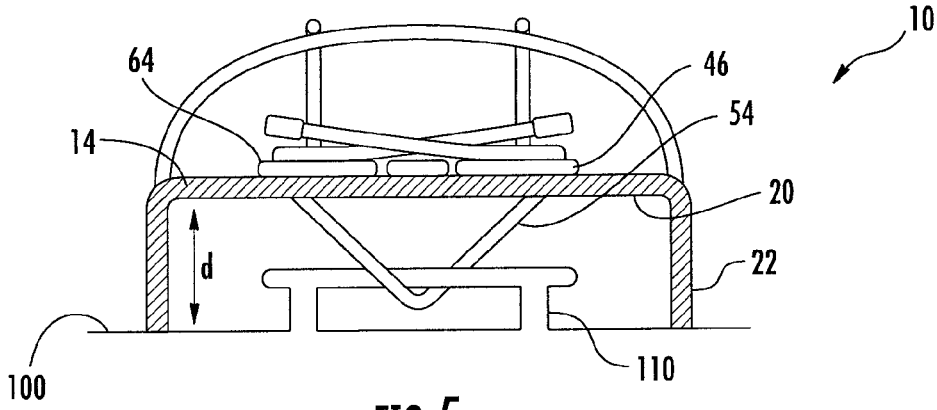
FIG. 5 is a cross-sectional side view of the lighting device secured to a surface by use of a cleat.

FIG. 5 sets forth another embodiment wherein side wall (22) is over the surface of an object (100). In this embodiment, surface (100) includes a cleat (110) commonly found on a boat or a dock wherein the elastic cord (54) is again drawn through the first cord fastener (46) and second cord fastener (64) so as to maintain tension on the cord, thereby positioning the light (10) against the surface of the object (100). The bottom (20) of the support plate (14) is shown a distance spaced above the cleat (110). As previously described, the side walls can be made of any size to accommodate any objects such as a cleat, suction cup, or any other object, whether the light is specifically manufactured for that size or where the side wall (22) can be modified at the point of installation to conform to the object thereby minimizing the side wall (22) height. It should also be noted that the cord fastener and support plate may be utilized for attaching any number of objects or devices to irregular surfaces without department from the scope of the invention.

Figure 6:
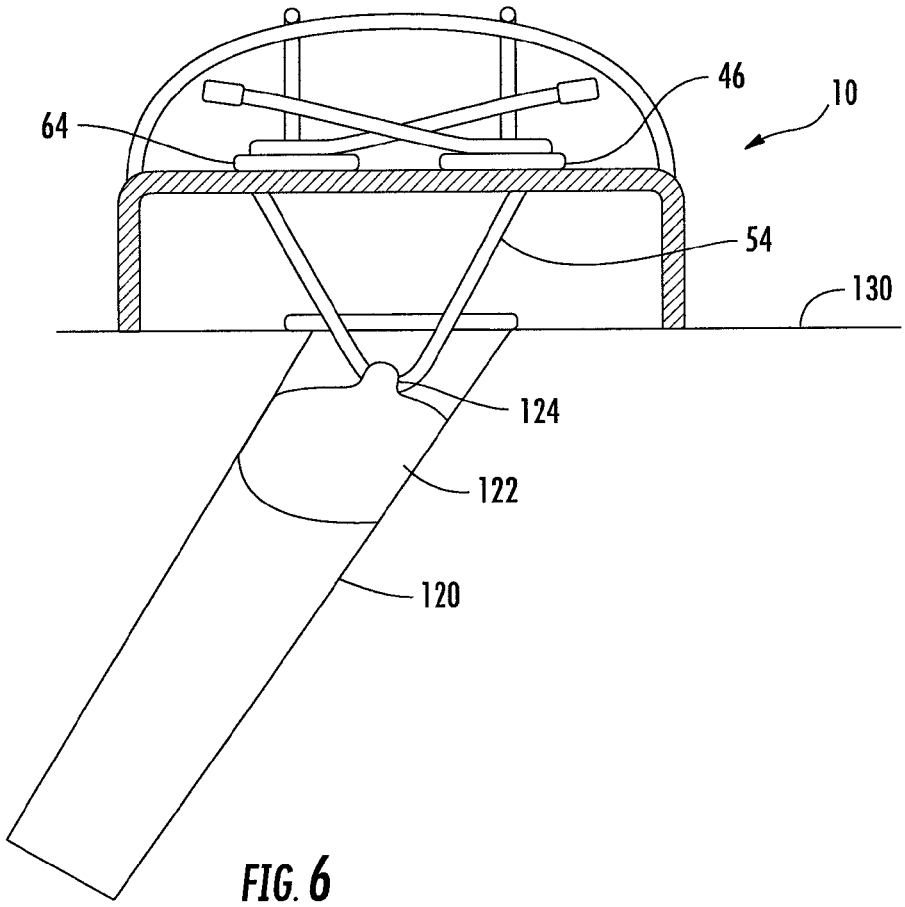
FIG. 6 is a cross-sectional side view of the portable lighting device secured to a fishing rod holder.

FIG. 6 sets forth an example of the light (10) being secured to a rod holder (120) commonly found on a fishing boat. In this embodiment, rod holder (120) includes an engagement ball (122) which works as a rod holder ball having a cord engagement tab (124). As in the previous embodiment, the cord (54) is drawn through cord fastener (46) and second cord fastener (64) so as to provide tension on the cord (54). Tension wedges the engagement ball (122) within the rod holder (120) to maintain the light (10) against the surface of a boat.

Figure 7:
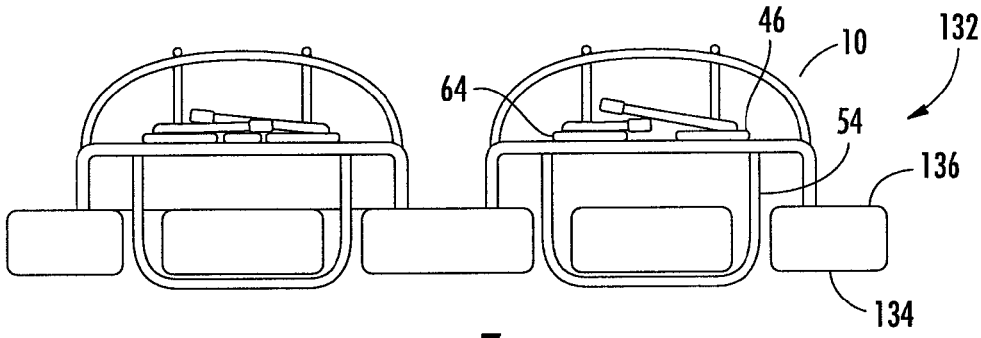
FIG. 7 is a cross-sectional side view of the portable lights attached to the planks on a dock.

FIG. 7 depicts the side view of a dock (132) having individual planks (134). In this example, the light (10) allows a cord (54) to extend around the dock plank (134) and, upon cinching the cord within first cord fastener (46) and second cord fastener (64), secures the light (10) against the upper surface (136) of the plank (134). In such an embodiment the lights (10) can be placed along the length of a dock and held securely in place so as to prevent accidental loss of the light due to wind, wave action or accidental bumping by a human, yet allows ease of securement to the dock on a temporary basis.

Figure 8:
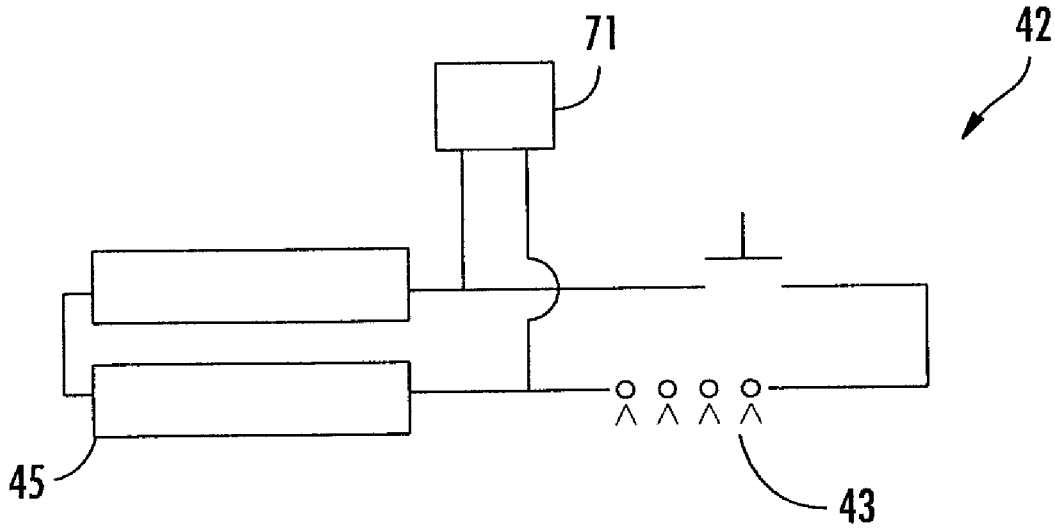
FIG. 8 is an electrical schematic of the lighting of the electric light.

FIG. 8 is a depiction of the electric light (42) having a plurality of LED lights (43) coupled to a battery source (45) operated by the switch (30). This rudimentarily type lighting circuit allows simplicity in design so that one or more electric lights may be placed upon the support plate with the LED lights drawing minimal power, so as to allow use of a small battery source such as lithium batteries. Alternatively, more conventional batteries can be used and a small solar panel (71) can be placed upon the support plate so as to receive sunlight for purposes of reenergizing the batteries during daylight hours.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A portable light comprising: a base defined by an elevated support plate having a perimeter edge with an upper surface and a lower surface, said support plate elevated by a continuous side wall extending outwardly therefrom; an electric light supported by said base; a cord fastener located on said upper surface of said support plate; an elastic cord having a first end secured to said base structure and a second end releasably connected to said cord fastener surface, said elastic cord having a length between said first end and said second end extending through said support plate for placement about a fixed object; wherein said first end of said elastic cord is pulled tight and cinched in said cord fastener whereby elasticity of said elastic cord maintains said cord within said cord fastener.

2. The portable light according to claim 1 including a transparent cover adapted and arranged to cover said upper surface of said support plate, and releasably secured thereto.

3. The portable light according to claim 2 wherein said transparent cover includes a hinge wherein said transparent cover can be rotated from an open position to a closed position.

4. The portable light according to claim 2 including a means for securing said transparent cover to said base.

5. The portable light according to claim 1 including a second cord fastener wherein said first end of said elastic cord is releasably secured to the first cord fastener and said second end of said elastic cord is releasably secured to the second cord fastener, said elastic cord length between said first end and said second end extending through said support plate for placement about a fixed object whereby said first end and said second end of said elastic cord are pulled tight with the elasticity of said elastic cord maintaining said cord within each said cord fastener.

6. The portable light according to claim 1 wherein said electric light is defined as a band of light emitting diodes (LEDs) powered by a battery power source with a switch electrically connected between said battery power source and said LEDs.

7. The portable light according to claim 6 including a solar panel for recharging said battery power source.

8. The portable light according to claim 1 wherein said support plate is elevated by said continuous side wall by at least one inch.

9. The portable light according to claim 1 wherein said cord fastener includes a cord slot formed from a plurality of angular positioned engagement tabs, said elastic cord positionable within while the elastic cord diameter is reduced under tension wherein the elasticity of said elastic cord maintains said cord within said cord slot when the tension is removed.

10. The portable light according to claim 1 including a suction cup having a cord engagement tab, wherein said suction cup can be secured to a flat surface of an object and said elastic cord can be placed through said cord engagement whereby said portable light is securable to the flat surface.

11. The portable light according to claim 1 including a magnet having a cord engagement tab, wherein said magnet can be secured to a metal surface of an object and said elastic cord can be placed through said cord engagement tab whereby said portable light is securable to the metal surface.

12. The portable light according to claim 1 including a rod holder ball having a cord engagement, wherein said rod holder ball can be placed within a rod holder of an object and said elastic cord can be placed through said cord engagement whereby said portable light is securable to the rod holder.

13. A portable light comprising: a base defined by an elevated support plate having a perimeter edge with an upper surface and a lower surface, said support plate elevated by a continuous side wall extending outwardly therefrom; an electric light formed from a band of light emitting diodes (LEDs) powered by a battery power source with a switch electrically connected between said battery power source and said LEDs positioned on said upper surface of said support plate; a transparent cover adapted and arranged to cover said upper surface of said support plate, and releasably secured thereto; a first and second cord fastener located on said upper surface of said support plate; and an elastic cord having a first end releasably secured to said first cord fastener and a second end releasably connected to said second cord fastener surface, said elastic cord having a length between said first end and said second end extending through said support plate for placement about a fixed object; wherein said first end and said second end of said elastic cord is pulled tight and cinched in said first and second cord fastener, whereby elasticity of said elastic cord maintains said cord within said cord fasteners.

14. The portable light according to claim 13 wherein said transparent cover includes a hinge wherein said transparent cover can be rotated from an open position to a closed position.

15. The portable light according to claim 14 including a means for securing said transparent cover to said base.

16. The portable light according to claim 13 including a solar panel for recharging said battery power source.

17. The portable light according to claim 13 wherein said support plate is elevated by said continuous side wall by at least one inch.

18. The portable light according to claim 13 wherein each said cord fastener includes a cord slot formed from a plurality of angular positioned engagement tabs, said elastic cord positionable within while the elastic cord diameter is reduced under tension wherein the elasticity of said elastic cord maintains said cord within said cord slot when the tension is removed.

19. The portable light according to claim 13 including a suction cup having a cord engagement tab, wherein said suction cup can be secured to a flat surface of an object and said elastic cord can be placed through said cord engagement tab whereby said portable light is securable to the flat surface.

20. The portable light according to claim 13 including a magnet having a cord engagement tab, wherein said magnet can be secured to a metal surface of an object and said elastic cord can be placed through said cord engagement tab whereby said portable light is securable to the metal surface.

21. The portable light according to claim 13 including a rod holder ball having a cord engagement, wherein said rod holder ball can be placed within a rod holder of an object and said elastic cord can be placed through said cord engagement tab whereby said portable light is securable to the rod holder.

* * * * *